US005450795A

United States Patent [19]

Adelman

[11] Patent Number: 5,450,795

[45] Date of Patent: Sep. 19, 1995

[54] PROJECTILE FOR SMALL FIREARMS

[75] Inventor: Barnet R. Adelman, Atherton, Calif.

[73] Assignee: Adelman Associates, Atherton, Calif.

[21] Appl. No.: 214,420

[22] Filed: Mar. 18, 1994

Related U.S. Application Data

[63] Continuation-in-part of Ser. No. 108,427, Aug. 19, 1993, abandoned.

[51] Int. Cl.[6] ..... F42B 8/14

[52] U.S. Cl. ..... 102/444; 102/502; 102/529; 244/3.3

[58] Field of Search ..... 102/395, 400, 439, 444, 102/498, 502, 506, 513, 517, 529; 273/418; 244/3.24, 3.27, 3.3

[56] References Cited

U.S. PATENT DOCUMENTS

| | | | |
|---|---|---|---|
| 2,112,758 | 3/1938 | Blacker | 102/517 |
| 2,426,239 | 8/1947 | Renner | 102/376 |
| 3,081,703 | 3/1963 | Kamp et al. | 102/50 |
| 3,156,187 | 11/1964 | Batou | 102/498 |
| 3,313,499 | 4/1967 | Ohman | 244/3.3 |
| 3,650,213 | 3/1972 | Abbott | 102/444 |
| 3,782,286 | 1/1974 | Jones et al. | 102/41 |
| 3,951,070 | 4/1976 | Flatau et al. | 102/502 |
| 3,952,662 | 4/1976 | Greenlees | 102/92.7 |
| 4,895,076 | 6/1990 | Looger et al. | 102/439 |
| 4,942,818 | 7/1990 | Saxby | 102/444 |
| 5,016,536 | 5/1991 | Brighton | 102/430 |
| 5,035,183 | 7/1991 | Luxton | 102/502 |
| 5,221,809 | 6/1993 | Cuadros | 102/439 |

FOREIGN PATENT DOCUMENTS

| | | | |
|---|---|---|---|
| 0488911A2 | 6/1992 | European Pat. Off. . | |
| 1580372 | 9/1969 | France | 102/513 |
| 2516579 | 3/1975 | Germany . | |

OTHER PUBLICATIONS

Report by J. H. Cuadros entitled A Comparison Between Rubber Bullets And Shot Bags.

*Primary Examiner*—Harold J. Tudor
*Attorney, Agent, or Firm*—Jack M. Wiseman

[57] ABSTRACT

A projectile for small firearms has an inner sealed container containing an impact charge of a mixture of pellets and a liquid or a mixture of pellets and a gel. This impact charge may be a mixture of dense metallic powder and a liquid or a mixture of dense metallic powder and a gel. The inner sealed container is rupturable upon impact with a target. An outer load distributing cover receives the inner sealed container and is shaped to provide a target impact surface greater than the target impact surface of the inner sealed container for reducing the force per unit area upon impact with a target. The outer load distributing cover is not penetrable by the impact charge upon impact with the target.

28 Claims, 3 Drawing Sheets

PROJECTILE FOR SMALL FIREARMS

RELATED APPLICATION

This application is a continuation-in-part of U.S. application, Ser. No. 08/108,427, filed on Aug. 19, 1993, now abandoned, by Barnet R. Adelman for Projectile For Small Firearms.

BACKGROUND OF THE INVENTION

The present invention relates in general to projectiles and, more particularly, to a projectile for small firearms.

Heretofore, less lethal projectiles for firearms were rubber bullets or fabric bag bullets containing lead shot or heavy metal powder, such as tungsten, copper or the like. The rubber bullets had a ball shape ranging in diameter from approximately one-half inch to one inch, or had a cylindrical configuration ranging in diameter from approximatley one-third inch to one inch, depending on the firearm from which the bullet was fired.

The rubber bullets were generally relatively hard, sometimes contained a metallic core, and delivered their impact energy over a relatively small area. As a consequence thereof, there has been a high probability of serious injury or death to the persons subjected to the impact.

The bean bag type projectiles had contained a load of shot or metal powder in a fabric bag. The shot or metal powder had weighed between three-quarter ounce to two or more ounces, depending on the gauge or caliber of the firearm from which it was fired. The fabric bag had a projected frontal area between four and sixteen square inches depending on the caliber or gauge of the firearm. The bean bag type projectiles were fired at a muzzle velocity of between one hundred fifty feet per second and four hundred and fifty feet per second with muzzle energies generally below sixty foot pounds.

It has been found that the bean bag type projectiles are aerodynamically inefficient, since they are generally flexible flat plates with the greater diameter thereof facing the direction of travel as they travel through the air. The drag on these projectiles is, therefore, relatively high, thus making it necessary to have a relatively high initial velocity in order to ensure a reasonably striking force at normal ranges, i.e. twenty to fifty yards.

It has also been found that the bean bag type projectile is relatively inaccurate in that it is difficult to predict the point of impact within a foot or more at ranges as short as twenty yards. Because of the high velocity and the difficulty of predicting accurately the point of impact, bean bag type projectiles tend to cause severe injury or death to persons hit at relatively short ranges, for example, ten to fifteen yards. This hazard is increased by the possibility that a targeted person may be hit in the face, or neck, or area directly over the heart, even though the projectile may be aimed at the midsection or lower extremity.

Heretofore, bullets have utilized shot suspended in a gel and contained in a thin copper or brass jacket. These projectiles have been designed to penetrate into the body of a person wherein the thin jacket fractures and enables the shot contained in the gel to be propelled in the body in a forceful manner. Such projectiles are intended to be more lethal and not less lethal.

SUMMARY OF THE INVENTION

An object of the present invention is to provide a projectile that can be fired from small firearms and be suitable for use by police departments, riot control troops, organizations for suppression of riots, by organizations employed for crowd control, and the like.

Another object of the present invention is to provide a projectile that can be fired from small firearms and, yet, is less lethal than projectiles presently used by police departments, riot control troops, organizations for suppression of riots, by organizations employed for crowd control, and the like.

Another object of the present invention is to provide a projectile for small firearms that travels through air as a ballistically efficient body and upon impact distributes the load over a relatively greater area, thus reducing the impact force per unit area without reducing the total impact force.

Another object of the present invention is to provide a projectile for small firearms that has a reasonably predictable trajectory for increase in accuracy and, yet, upon impact distributes the load over a relatively greater area, thus reducing the impact force per unit area without reducing total impact force.

A feature of the present invention is the capability of reducing muzzle velocity for a given caliber small firearm firing the projectile, thus reducing the probability of lethal impact at relatively short distances.

A projectile for small firearms comprising an inner sealed container containing shot or powdered metal. The inner sealed container is rupturable upon impact with a target. An outer load distributing cover receives the inner sealed container and is configured to provide a target impact surface greater than the target impact surface of the inner sealed container for reducing the force per unit area upon impact with a target. The outer load distributing cover is not penetrable by shot or powdered metal upon impact with a target.

DESCRIPTION OF THE PREFERRED EMBODIMENT

Figure 1:
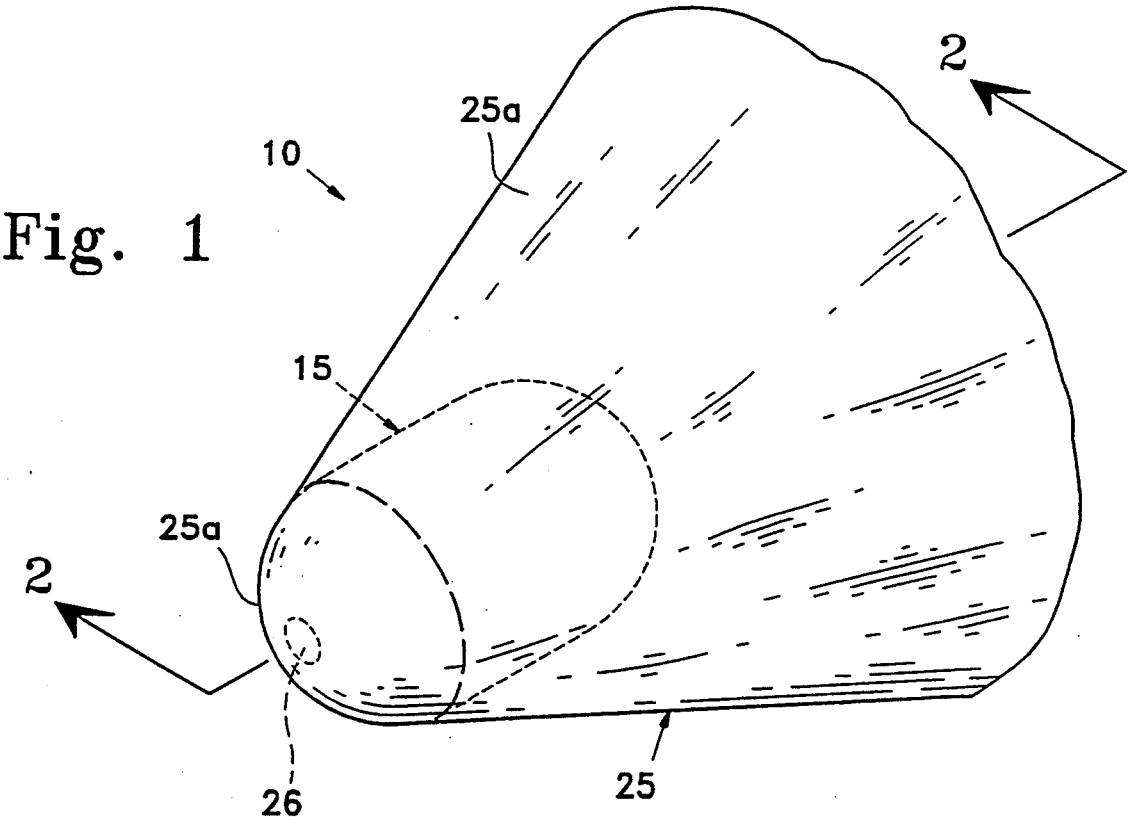
FIG. 1 is a diagrammatic perspective view of the projectile embodying the present invention illustrated in flight.
Figure 2:
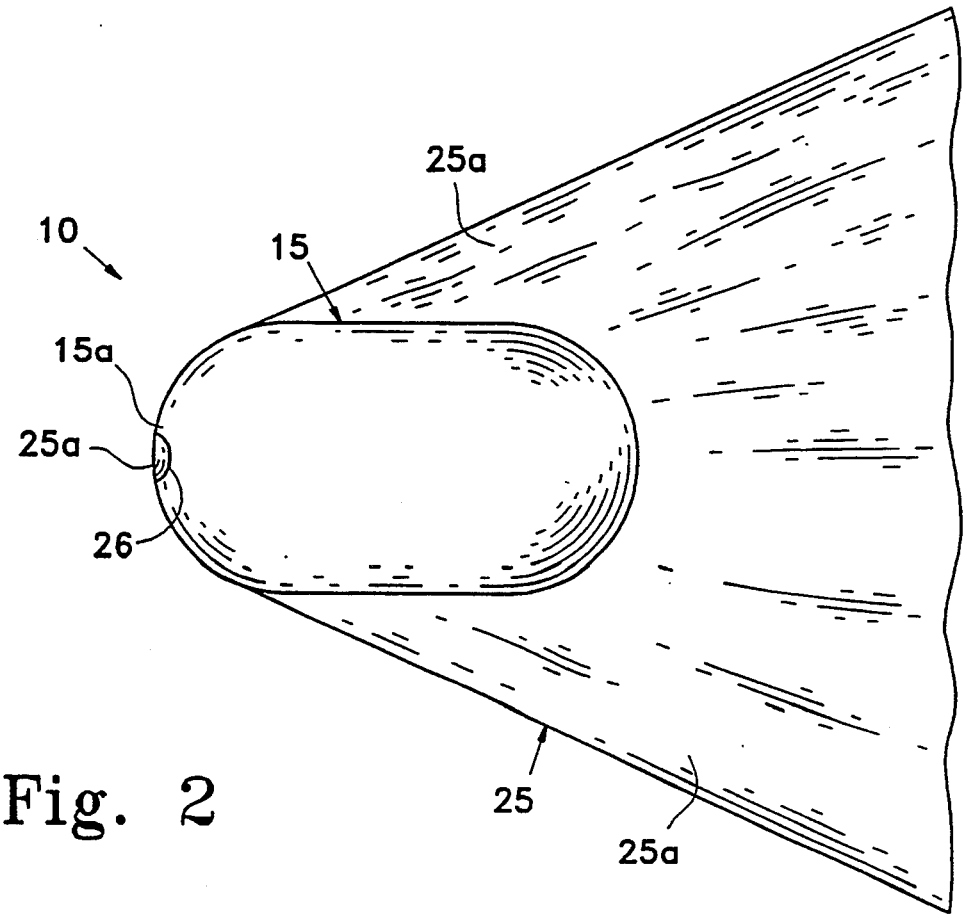
FIG. 2 is a diagrammatic sectional view of the projectile shown in FIG. 1 taken along line 2—2 of FIG. 1 with an inner sealed container shown in elevation, the projectile being illustrated in flight.
Figure 3:
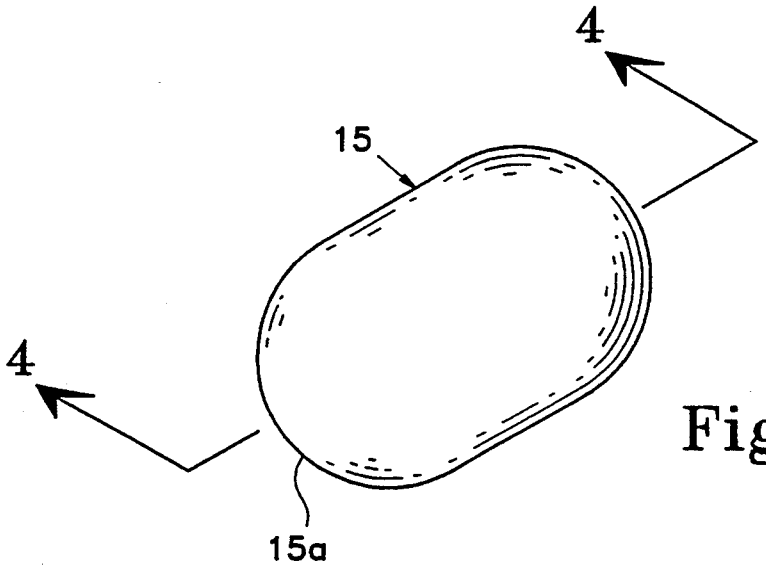
FIG. 3 is a diagrammatic perspective view of the inner sealed container.
Figure 4:
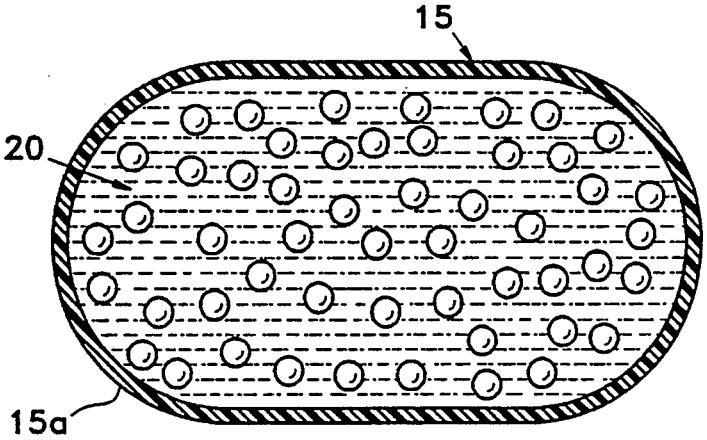
FIG. 4 is an enlarged diagrammatic sectional view of the inner sealed container taken along line 4—4 of FIG. 3.

Illustrated in FIGS. 1 and 2 is a projectile 10 embodying the present invention depicted in flight. The projectile 10 is adaptable for use in relatively large smoothbore shotguns, such as 410, 28, 20, 16, 12 and 10 gauge shotguns. The muzzle velocities for shotguns with relatively large smooth bores are in the neighborhood of 150–350 feet per second. The projectile 10 is also adaptable for use in medium to large caliber handguns, such as 0.38 Special, 357, 41, 44, 45 and 50 caliber revolvers. In using the projectile 10 for revolvers, the muzzle velocities are in the range between 300 and 500 feet per second to compensate for the lower charge weight which is generally limited to one-third to two-thirds ounces.

The projectile 10 comprises an inner sealed container 15 made of suitable material capable of rupturing upon impact with a target. In the preferred embodiment, the inner sealed container 15 has a generally cylindrical configuration with an impact or frontal face 15*a*. It is apparent that the inner sealed container 15 may also have a generally spherical configuration with an impact or frontal face. In the exemplary embodiment, the inner sealed container 15 is made of flexible, elastic material, such as rubber, latex, film, polyurethane, polypropylene, polyethylene, polymeric material, or the like which are capable of encapsulating impact charge or shot charge and are capable of rupturing on impact with a target.

Contained by the inner sealed container 15 are suitable impact or shot charge 20. In the preferred embodiment, the impact or shot charge is a mixture of pellets and a liquid or a mixture of pellets and a gel. While reference is made to pellets, it is to be understood that heavy metal powders or metallic elements can be used in lieu of pellets. The metallic elements, in the exemplary embodiment, are leadshot, copper shot, tungsten powder, or the like. The liquid or gel elements, in the exemplary embodiment, are glycerin, mixture of glycerin and alcohol, solutions of salt water, non-poisonous anti-freeze, silicone gels, viscous liquids, low molecular weight polymers, or the like. The ratio of the weight of the fluid element to the solid element of the impact or load charge 20, in the exemplary embodiment, can be varied between zero to approximately fifty percent depending upon the caliber of the small firearm and the type of metal element employed. The inner sealed container 15 is sized, in the preferred embodiment, to just contain the impact or load charge with a relatively small ullage. The fluid element of the impact charge 20 serves to ensure the rupturability of the inner sealed container 15, when there is an impact between inner sealed container 15 and a target, by virtue of the fluid pressure created by the fluid element in flight.

The inner sealed container 15 is disposed within an outer load distributing cover or member 25, which is impenetrable by the impact or load charge. In the exemplary embodiment, the cover 25 is made of relatively strong, flexible lightweight fabric that will not permit the impact or load charge to penetrate through it upon impact with a target, but will distribute the load or impact force over an increased area, thus reducing the force per unit area of impact without reducing the total impact. In the exemplary embodiment, the outer load distributing cover 25 may be made from nylon, dacron, KEVLAR, spectra, silk, or any other flexible fabric which will not permit the impact or shot load to penetrate through it upon impact with a target. The projectile 10 (FIG. 5) is folded over for insertion into a conventional shell 30 for forming a cartridge 35 for small firearms. The outer load distributing cover 25 has an impact surface 25*a* which is greater than the impact surface 15*a* of the inner sealed container 15 and extends outwardly beyond the impact surface 15*a* of the inner sealed container 15 (FIG. 2). The inner sealed container 15, in the preferred embodiment, is suitably cemented to or otherwise suitably attached to the outer load distributing cover 25 at 26. A suitable cement is a cyanoacrylate polymer manufactured by Loctite Corporation of Cleveland, Ohio. Toward this end, the frontal face 15*a* of the inner sealed container 15 is suitably cemented or otherwise suitably attached to the impact surface 25*a* of the outer load distributing cover 25. By cementing or attaching the inner sealed container 15 to the outer load distributing cover 25, the scattering of the shot charge 20 on impact is reduced to reduce unintentional injury to persons in the general vicinity of the target.

In the preferred embodiment, the outer load distributing cover 25 has an efficient ballistic configuration in flight and upon impact distributes the load or impact force over an increased area, thus reducing the force per unit area of impact without reducing the total impact. Toward this end, the outer load distributing cover 25 has a generally conical or generally pyramidal configuration in flight. Partially nested in the impact surface 25*a* of the outer load distributing cover 25 is the impact surface 15*a* at the forward end of the inner sealed container 15. The outer load distributing cover 25 may have other suitable aerodynamically efficient configurations in flight in addition to the circular cross sectional area, such as square or rectangular cross-section areas, as long as the load or impact force is distributed over an increased area upon impact with a target. An efficient ballistic configuration in flight may also provide a predictable trajectory and a substantial increase in accuracy. Additionally, an outer cover providing improved aerodynamic efficiency in flight also serves to reduce muzzle velocity for a given caliber small firearm, since the projectile 10 can be fired at a reduced muzzle velocity at shorter ranges to reduce the lethality of impact. A smooth, gradually increasing outer surface reduces flight turbulence and increases aerodynamic efficiency.

Figure 5:
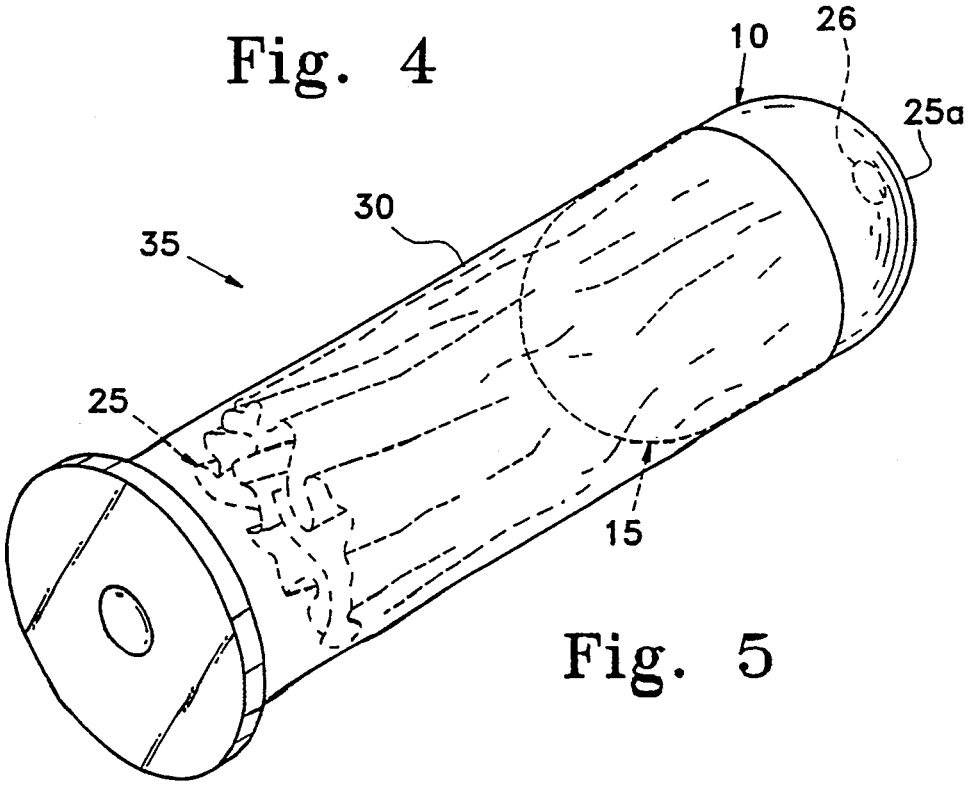
FIG. 5 is a diagrammatic perspective view of the projectile embodying the present invention disposed in a shell to form a cartridge suitable for a small firearm.
Figure 6:
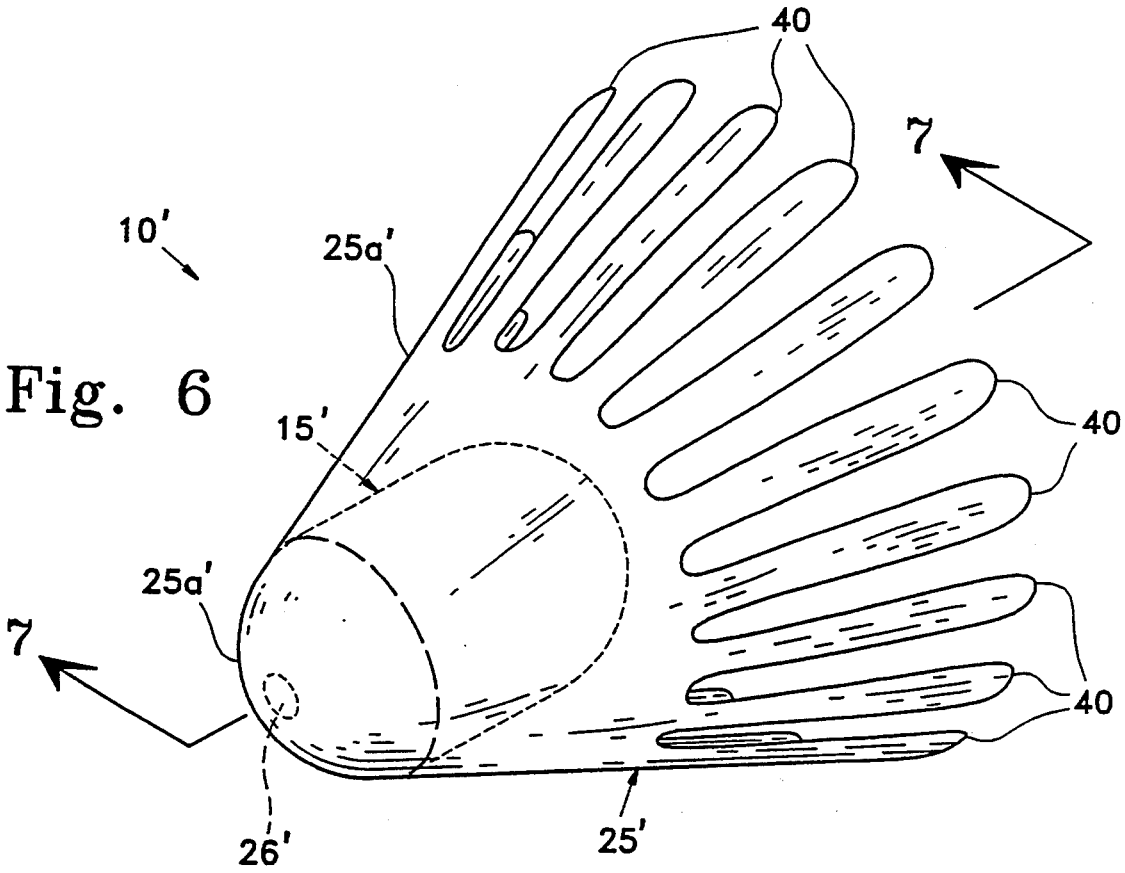
FIG. 6 is a diagrammatic perspective view of a modified projectile embodying the present invention illustrated in flight.
Figure 7:
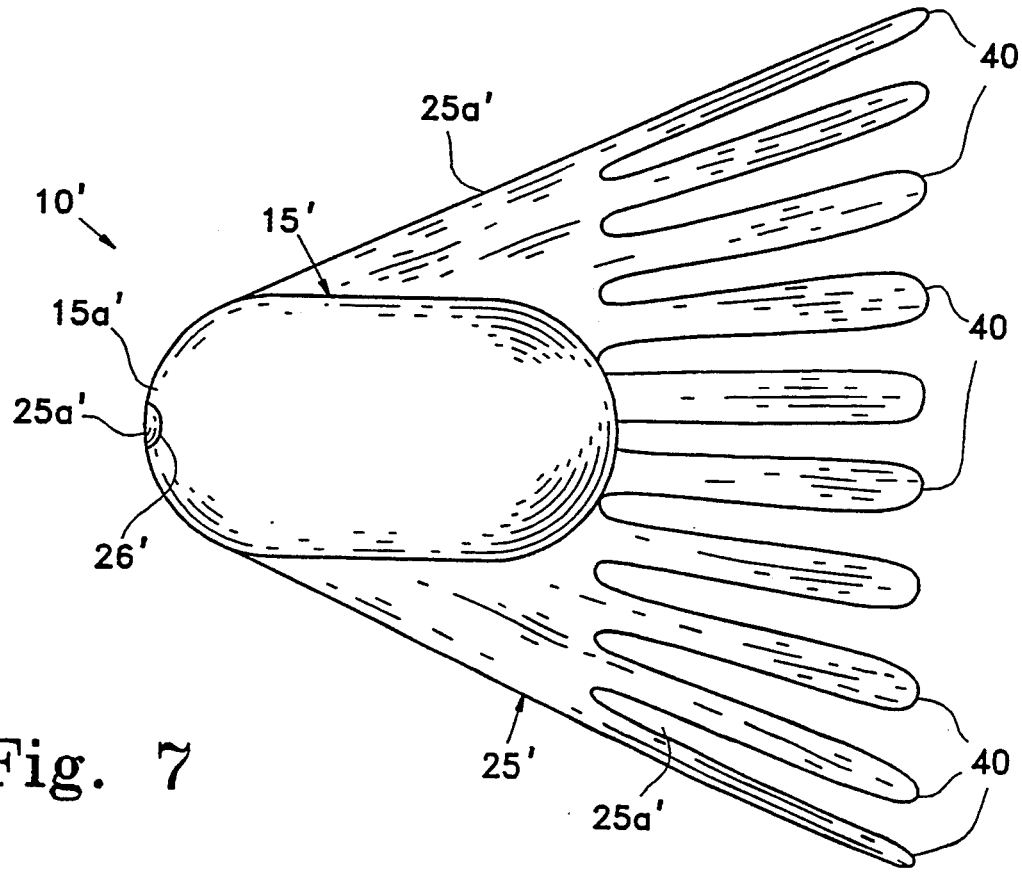
FIG. 7 is a diagrammatic sectional view of the projectile shown in FIG. 6 taken along line 7—7 of FIG. 6.

Illustrated in FIGS. 6 and 7 is a projectile 10', which is a modification of the projectile 10 illustrated in FIGS. 1, 2 and 5. Parts in projectile 10' that are similar to parts in the projectile 10 have the same reference numeral but with a prime suffix. Projectile 10' differs from the projectile 10 in that the outer load distributing cover 25' has a trailing end formed with spaced, rearwardly projecting, elongated sections 40 along the rearward peripheral edge thereof. The sections 40 serve to improve dynamic stability for the projectile 10'.

What is claimed is:

1. A projectile for small firearms comprising:

(a) an inner sealed container containing an impact charge and having a target impact area, said sealed container being rupturable upon impact with a target; and (b) an outer load distributing cover receiving said inner sealed container, said outer load distributing cover being impenetrable by engagement with the impact charge, said outer load distributing cover being greater in target impact area than the target impact area of said inner sealed container, said outer load distributing cover being in the form of a receptacle to receive and contain the impact charge released from said inner sealed container after said inner sealed container is ruptured upon impact with a target and to provide an impact area with a target greater than the impact area of said inner sealed container for reducing the force per unit area upon impact with a target.

2. A projectile for small firearms as claimed in claim 1 wherein said impact charge within said inner sealed container comprises a mixture of pellets and a liquid element.

3. A projectile for small firearms as claimed in claim 1 wherein said impact charge within said inner sealed container comprises a mixture of pellets and a gel.

4. A projectile for small firearms as claimed in claim 1 wherein said impact charge within said inner sealed container comprises a mixture of powdered metallic charge and a liquid element.

5. A projectile for small firearms as claimed in claim 1 wherein said impact charge within said inner sealed container comprises a mixture of powdered metallic charge and a gel.

6. A projectile for small firearms as claimed in claim 1 wherein said outer load distributing cover has a gradually increasing outer surface in the rearward direction for aerodynamic efficiency.

7. A projectile for small firearms as claimed in claim 1 wherein said outer load distributing cover has a generally conical shape gradually increasing in dimension in the rearward direction for aerodynamic efficiency.

8. A projectile for small firearms as claimed in claim 1 wherein said inner sealed container is attached at its forward end to the forward end of said outer load distributing cover.

9. A projectile for small firearms as claimed in claim 2 wherein said outer load distributing cover has a gradually increasing outer surface in the rearward direction for aerodynamic efficiency.

10. A projectile for small firearms as claimed in claim 3 wherein said outer load distributing cover has a gradually increasing outer surface in the rearward direction for aerodynamic efficiency.

11. A projectile for small firearms as claimed in claim 4 wherein said outer load distributing cover has a gradually increasing outer surface in the rearward direction for aerodynamic efficiency.

12. A projectile for small firearms as claimed in claim 5 wherein said outer load distributing cover has a gradually increasing outer surface in the rearward direction for aerodynamic efficiency.

13. A projectile for small firearms as claimed in claim 1 wherein said outer load distributing cover has a rearward peripheral edge and is formed with spaced, rearwardly projecting, elongated sections along the rearward peripheral edge thereof for improved dynamic stability for the projectile.

14. A projectile for small firearms as claimed in claim 7 wherein said outer load distributing cover has a rearward peripheral edge and is formed with spaced, rearwardly projecting, elongated sections along the rearward peripheral edge thereof for improved dynamic stability for the projectile.

15. A cartridge for small firearms comprising:

(a) a shell;

(b) an inner sealed container disposed within said shell, said inner sealed container containing an impact charge and having a target impact area, said inner sealed container being rupturable upon impact with a target; and (c) an outer load distributing cover disposed in said shell, said outer load distributing cover receiving said inner sealed container, said outer load distributing cover being impenetrable by engagement with the impact charge, said outer load distributing cover being greater in target impact area than the target impact area of said inner sealed container, said outer load distibuting cover being in the form of a receptacle to receive and contain the impact charge released from said inner sealed container after said inner sealed container is ruptured upon impact with a target and to provide an impact area with a target greater than the impact area of said inner sealed container for reducing the force per unit area upon impact with a target.

16. A cartridge for small firearms as claimed in claim 15 wherein said impact charge within said inner sealed container comprises a mixture of pellets and a liquid element.

17. A cartridge for small firearms as claimed in claim 15 wherein said impact charge within said inner sealed container comprises a mixture of pellets and a gel.

18. A cartridge for small firearms as claimed in claim 15 wherein said impact charge within said inner sealed container comprises a mixture of powdered metallic charge and a liquid element.

19. A cartridge for small firearms as claimed in claim 15 wherein said impact charge within said inner sealed container comprises a mixture of powdered metallic charge and a gel.

20. A cartridge for small firearms as claimed in claim 15 wherein said outer load distributing cover has a gradually increasing outer surface in the rearward direction for aerodynamic efficiency.

21. A cartridge for small firearms as claimed in claim 15 wherein said outer load distributing cover has a generally conical shape gradually increasing in dimension in the rearward direction for aerodynamic efficiency.

22. A cartridge for small firearms as claimed in claim 15 wherein said inner sealed container is attached at its forward end to the forward end of said outer load distributing cover.

23. A cartridge for small firearms as claimed in claim 16 wherein said outer load distributing cover has a gradually increasing outer surface in the rearward direction for aerodynamic efficiency.

24. A cartridge for small firearms as claimed in claim 17 wherein said outer load distributing cover has a gradually increasing outer surface in the rearward direction for aerodynamic efficiency.

25. A cartridge for small firearms as claimed in claim 18 wherein said outer load distributing cover has a gradually increasing outer surface in the rearward direction for aerodynamic efficiency.

26. A cartridge for small firearms as claimed in claim 19 wherein said outer load distributing cover has a gradually increasing outer surface in the rearward direction for aerodynamic efficiency.

27. A projectile for small firearms comprising:

(a) an inner sealed container containing an impact charge and having a target impact area, said inner sealed container being rupturable upon impact with a target; and (b) an outer load distributing member being disposed in the path of the impact charge released from said inner sealed container when said inner sealed container has been ruptured, said outer load distributing member being impenetrable upon engagement with said impact charge, said outer load distributing member having a target impact area greater than the target impact area of said inner sealed container to provide an impact area with a target greater than the target impact area of said inner sealed container for reducing the force per unit area upon impact with a target, said inner sealed container being attached at its forward end to the forward end of said outer load distributing member.

28. A cartridge for small firearms comprising:

(a) a shell:

(b) an inner sealed container disposed within said shell, said inner sealed container containing an impact charge and having a target impact area, said inner sealed container being rupturable upon impact with a target; and (c) an outer load distributing member disposed in said shell, said outer load distributing member being disposed in the path of impact charge released from inner sealed container when said inner sealed container has ruptured, said outer load distributing member being impenetrable upon engagement with said impact charge, said outer load distributing member having a target impact area greater than the target impact area of said inner sealed container to provide an impact area with a target greater than the target impact area of said inner sealed container for reducing the force per unit area upon impact with a target, said inner sealed container being attached at its forward end to the forward end of said outer load distributing member.

* * * * *